US008505327B2

(12) United States Patent
Son et al.

(10) Patent No.: US 8,505,327 B2
(45) Date of Patent: Aug. 13, 2013

(54) INDOOR UNIT FOR AIR CONDITIONER

(75) Inventors: Yang-Mo Son, Kyungsangnam-do (KR); Jeong-Weon Ju, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 758 days.

(21) Appl. No.: 12/086,352

(22) PCT Filed: Nov. 13, 2006

(86) PCT No.: PCT/KR2006/004754

§ 371 (c)(1),
(2), (4) Date: Jul. 28, 2010

(87) PCT Pub. No.: WO2007/081083

PCT Pub. Date: Jul. 19, 2007

(65) Prior Publication Data

US 2010/0287973 A1 Nov. 18, 2010

(30) Foreign Application Priority Data

Jan. 16, 2006 (KR) ..... 10-2006-0004226
Jan. 16, 2006 (KR) ..... 10-2006-0004228
Jan. 16, 2006 (KR) ..... 10-2006-0004229

(51) Int. Cl.
*F25D 17/04* (2006.01)

(52) U.S. Cl.
USPC ..... 62/407

(58) Field of Classification Search
USPC ..... 62/302, 129, 156, 259.1, 263, 407, 62/408
See application file for complete search history.

(56) References Cited

U.S. PATENT DOCUMENTS

| | | | | |
|---|---|---|---|---|
| 4,782,999 | A * | 11/1988 | Ishii et al. | 236/49.3 |
| 5,878,591 | A | 3/1999 | Tsuji et al. | |
| 5,943,872 | A * | 8/1999 | Sakurada et al. | 62/262 |
| 2002/0189274 | A1 | 12/2002 | Lee et al. | |

FOREIGN PATENT DOCUMENTS

| | | | |
|---|---|---|---|
| CN | 1712800 | A | 12/2005 |
| EP | 0 811 810 | A2 | 12/1997 |
| JP | 07-055184 | | 3/1995 |
| JP | 2003014249 | A | 1/2003 |
| JP | 2003-83602 | A | 3/2003 |
| JP | 2004163077 | A | 6/2004 |
| JP | 2004-184051 | | 7/2004 |
| KR | 10-2001-0018277 | A | 3/2001 |
| KR | 10-2004-0014755 | A | 2/2004 |
| KR | 10-2004-0110412 | A | 12/2004 |
| KR | 10-2005-0119735 | A | 12/2005 |

* cited by examiner

*Primary Examiner* — Melvin Jones
(74) *Attorney, Agent, or Firm* — McKenna, Long & Aldridge, LLP

(57) ABSTRACT

An indoor unit for an air conditioner includes a front frame, a main chassis coupled on a rear portion of the front frame, an air discharge vane provided on a lower end of the front frame to control a discharge direction of cooled air, and an connecting frame provided in rear of the air discharge vane to allow an assembling or maintenance of the air discharge vane to be easily performed.

19 Claims, 9 Drawing Sheets

INDOOR UNIT FOR AIR CONDITIONER

This application is a national stage entry of PCT Patent Application No. PCT/KR2006/004754, filed Nov. 13, 2006, and claims the benefit of: Korean Patent Application No. 10-2006-0004226, filed Jan. 16, 2006; Korean Patent Application No. 10-2006-0004228, filed Jan. 16, 2006; and Korean Patent Application No. 10-2006-0004229, filed Jan. 16, 2006, which are all hereby incorporated herein by reference in their entireties.

TECHNICAL FIELD

The present invention relates to an air conditioner for an indoor unit.

BACKGROUND ART

Generally, an air conditioner is a system that is used to control the temperature, relative humidity or purity of air, ad to circulate cooled air in an enclosed space such as a room. The air conditioner is classified into an integration type where all of components are provided in a unit and a separation type having indoor and outdoor units separated from each other.

FIG. 1 shows a perspective view of an indoor unit of a conventional air conditioner.

Referring to FIG. 1, an indoor unit of a conventional air conditioner includes a main chassis 1 mounted on an inner wall of a room, a front panel 3 installed in front of the main chassis 1, an air intake grill 5*a* formed on the front panel 3, and an air discharge grill 7 installed on a lower end of the front panel 3. A display unit 9 for display a current operation state and guiding the manipulation of a user is installed between the air intake and discharge grills 5*a* and 7.

Meanwhile, another intake grill 5*b* may be further provided on a top surface of the main chassis 1. In addition, the front panel 3 may be provided at a lower end with a hole in which an air discharge unit for guiding the downward discharge of the cooled air can be fitted.

The conventional air conditioner has the following problems.

Since the front panel 3 is provided at the lower end with only a receiving hole having a size identical to the air discharge unit, it is difficult to assemble the air discharge grill, air discharge panel 170 and air discharge louver and to perform the maintenance service.

In addition, during the discharge of the cooled air to the room, the cooled air may leak through a coupling portion between the main chassis and the front panel.

Furthermore, since a temperature sensor is installed on a front surface of the heat exchanger, it is difficult to accurately measure the room temperature. That is, the temperature detected by the temperature sensor is closer to the surface temperature of the heat-exchanger and thus the room temperature cannot be accurately detected by the temperature sensor.

DISCLOSURE OF INVENTION

Technical Problem

An object of the present invention is to provide an indoor unit for an air conditioner that substantially obviates one or more problems due to limitations and disadvantages of the related art.

An object of the present invention is to provide an indoor unit for an air conditioner that can improve the convenience in performing the maintenance service for internal components of the indoor unit.

Another object of the present invention is to provide an indoor unit for an air conditioner that can prevent the cooled air from leaking through a coupling portion between a front frame and a main chassis.

Another object of the present invention is to provide an indoor unit for an air conditioner that can accurately detect the room temperature by improving the mounting structure of the temperature sensor.

Technical Solution

To achieve these objects and other advantages and in accordance with the purpose of the invention, as embodied and broadly described herein, there is provided an indoor unit for an air conditioner, including: a front frame; a main chassis coupled on a rear portion of the front frame; an air discharge vane provided on a lower end of the front frame to control a discharge direction of cooled air; and an connecting frame provided on a rear portion of the air discharge vane to allow an assembling or maintenance of the air discharge vane to be easily performed.

In another aspect of the present invention, there is provided an indoor unit for an air conditioner, including: a casing including a front frame and a main chassis; an air discharge panel slidably coupled to the front frame; an air discharge vane provided on a lower end of the casing to discharge the cooled air downward; and an air sealing member connecting the front frame to a side surface of the main chassis to prevent air leakage.

In still another aspect of the present invention, there is provided an indoor unit for an air conditioner, including: a front frame; a main chassis coupled on a rear portion of the front frame; an air sealing member connecting the front frame to a side surface of the main chassis; a connecting frame slidably coupled to a lower end of the front frame; and a temperature sensor provided on the air sealing member to measure the temperature of the room air.

Advantageous Effects

According to the present invention, since the connecting frame is detachably mounted on the lower end of the front frame, it is convenient to perform the maintenance service for the internal components such as the air discharge vane.

In addition, since the connecting frame is connected to both of the front frame and the main chassis, the front frame can be more securely coupled to the main chassis.

Furthermore, since the air discharge panel and air discharge vane are provided on the lower end of the front frame, the discharge direction of the air can be controlled and thus the air circulation can be more effectively realized.

In addition, since the air sealing member is provided between the front frame and the main chassis, the air leakage through the gap between the front frame and the main chassis can be prevented.

Since the components can be commonly used by the air sealing member, the manufacturing cost can be reduced. That is, since the panel driving unit for driving the air discharge panel and front-upper panel is installed on the front frame, the horizontal length of the front frame increases. In this case, by providing the air sealing member, a conventional main chassis can be used. Therefore, there is no need to prepare a new main chassis for the front frame having the increased length. Therefore, the manufacturing cost can be remarkably reduced.

In addition, since the temperature detecting sensor is detachably mounted on the air sealing member, the room temperature can be accurately detected.

That is, since the temperature sensor is installed far away from the heat exchanger, a factor affecting the temperature detection is eliminated and thus the room temperature can be accurately detected. Furthermore, since the air hole is formed in the air sealing member on which the temperature sensor is mounted, the room air can effectively contact the temperature sensor and thus the room temperature can be accurately measured.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

While the present invention has been particularly shown and described with reference to exemplary embodiments thereof, it will be understood by those of ordinary skill in the art that various changes in form and details may be made therein without departing from the spirit and scope of the present invention as defined by the following claims.

Figure 1:
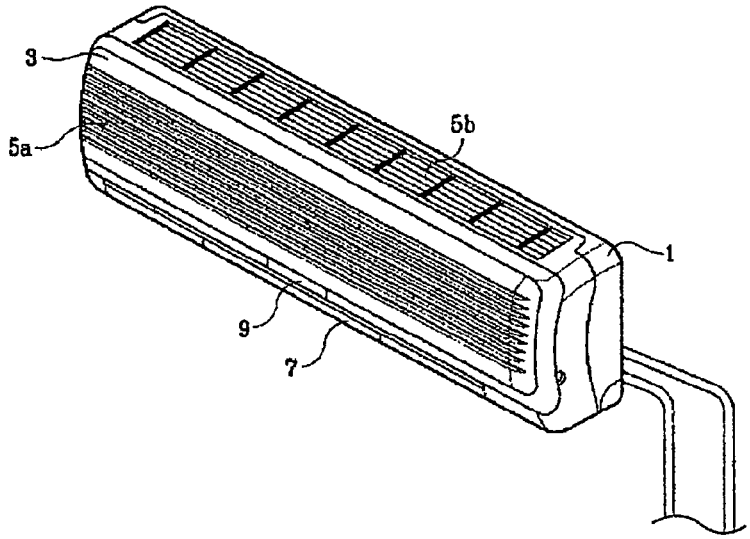
FIG. 1 is a perspective view of an indoor unit of a conventional separation type air conditioner.
Figure 2:
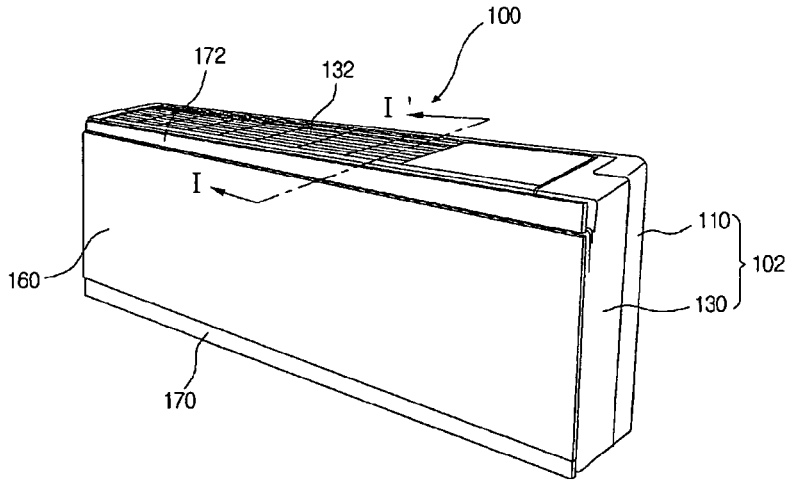
FIGS. 2 and 3 are perspective views of an indoor unit for an air condition according to an embodiment of the present invention.
Figure 3:
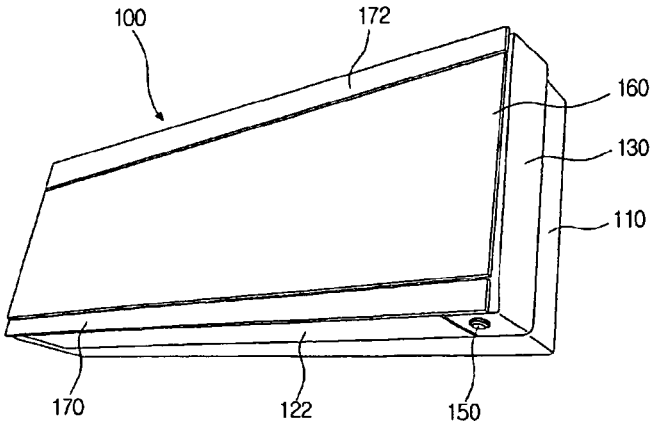

FIGS. 2 and 3 show an indoor unit for an air conditioner according to an embodiment of the present invention.

Referring to FIGS. 2 and 3, an indoor unit 100 includes a casing 102, a front panel 160 coupled to a front portion of the casing 102, an air discharge panel 170 slidably coupled to a lower end of the front panel 160, a front-upper panel 172 slidably coupled to an upper end of the front panel 160, and an air discharge vane 122 slidably coupled to a lower end of the casing 102.

The casing 102 includes a main chassis 110 and a front frame 130 coupled to a front portion of the main chassis 110 and a front frame 130 coupled to a front portion of the main chassis 110. An air intake grill 132 is formed on a top surface of the front frame 130 and a remote control signal receiving portion 150 is formed on a lower portion of the casing 102.

The air introduced through the air intake grill 132 passes through a heat exchanger installed in the indoor unit and is then discharged to the room through the air discharge vane 122. By the vertical movement of the air discharge panel 170, the air is discharged frontward from the indoor unit 100. This will be described later.

Figure 4:
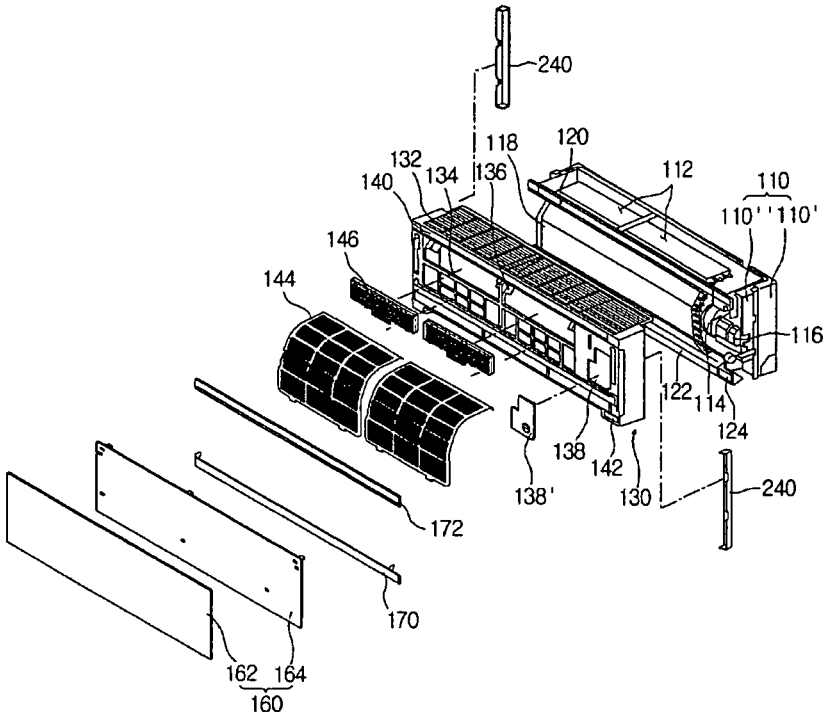
FIG. 4 is an exploded perspective view of the indoor unit of FIGS. 2 and 3.
Figure 5:
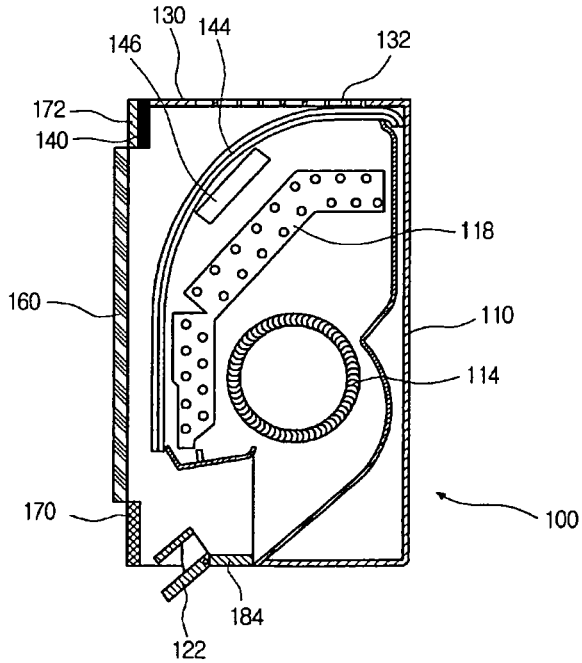
FIG. 5 is a sectional view taken along line I-I of FIG. 2.

FIG. 4 is an exploded perspective view of the indoor unit and FIG. 5 is a side sectional view of the indoor, which is taken along line I-I' of FIG. 2.

Referring to FIGS. 4 and 5, the indoor unit 100 of the air conditioner is formed in a hexahedron shape and the casing defines a contour of the indoor unit 100.

That is, the indoor unit 100 includes a heat exchanger 118 coupled to a front portion of the main chassis 110 to allow the air introduced to heat-exchange with a refrigerant, a blower fan 114 installed in rear of the heat exchanger 118 to intake and discharge the indoor air, a motor assembly 116 installed on a side portion of the main chassis 110 to drive the blower fan 114, and an air filter 144 and electric dust collector 146 detachably mounted on the front portion of the front frame 130.

The main chassis 110 includes a rear chassis unit 110' defining a rear contour of the main chassis 110 and a front chassis unit 110" positioned in front of the rear chassis 110' The main chassis 110 is provided at the top with an air inlet 112 through which the indoor air is introduced. The air intake grill is positioned on the air inlet 112.

The blower fan 114 may be a cross flow fan arranged horizontally. The air introduced through the air inlet 112 is discharged through the air discharge vane 122 by the blower fan 114.

The motor assembly 116 is installed at right side of the flower fan 114 to generate rotational force using electric power applied from an external side. The rotational force generated by the motor assembly 116 is transmitted to the flower fan 114.

In addition, the heater exchanger 118 is installed in front of the front chassis 110" to heat-exchange the air introduced through the air inlet 112 with the air. That is, like the blower fan 114, the heat exchanger 118 is disposed to extend horizontally such that it can enclose the front and upper portions of the blower fan 114. The main display unit 120 is formed on the front-upper end of the front chassis 110". The main display unit 120 displays a variety of information and is selectively screened by the front-upper panel 172.

The air discharge vane 122 installed on the lower end of the front chassis unit 110" over the lower end of the front frame 130.

The air discharge vane 122 is driven by a driving unit (not shown) and simultaneously or independently opened and closed together with or from the air discharge panel 170 and the front-upper panel 172.

A mode display unit 124 is further provided on the front-right-lower end of the front chassis unit 110". The mode display unit 124 displays a current operation mode or a current setting state of the air conditioner.

The front frame is installed in front of the main-chassis. That is, the front frame 130 defines a front contour of the indoor unit 100. The front frame 130 is coupled to enclose the front chassis unit 110" of the main chassis 110. The air intake grill 132 is formed on a top of the front frame 130. That is, the air intake grill 132 is positioned above the air inlet 112 of the main chassis 110 when the front frame 130 is coupled to the main chassis 110. The air intake grill 132 is provided with a plurality of slits through which the air passes.

The front frame 130 is provided with a filter supporting portion 134 and dust collector supporting portion 136 for respectively supporting the air filter 144 and dust collector 146. A checking hole 138 is formed near a front-right end of the front frame 130. A checking plate 138' is selectively mounted in the checking hole 138. Therefore, the checking plate 138' selectively opens and closes the checking hole 138.

A display window 140 is formed on a front-upper end of the front frame 130. The display window 140 is sized to correspond to the main display unit 120 of the main chassis 110 and formed in a transparent material. Therefore, the information displayed on the main display unit 120 can be identified in front of the front frame 130.

Meanwhile, a mode display window 142 is formed on a front-lower right side of the front frame 130. The mode display window 142 is also formed of a transparent material and sized to correspond to the mode display unit 124 of the main chassis 110. Therefore, the information displayed on the mode display unit 124 can be identified in front of the front frame.

As described above, the air filter 144 and the electric dust collector 146 are mounted on the front frame 130. Here, the air filter 144 functions to filter off foreign objects contained in the air introduced through the air inlet 112. The air filter 130 is installed on the front and upper portions of the front frame 130. The air filter 144 is formed of a flexible material so that it can be curved at a predetermined curvature when viewed from a side.

In addition, the electric dust collector 146 functions to collect foreign objects such as dusts contained in the air through an ionizing process using electric power applied from the external side. The electric dust collector 146 is installed in rear of the air filter 144 and supported by the dust collector supporting portion 136.

In addition, the remote control signal receiving unit 150 has a circular button structure for receiving a signal transmitted from a remote controller, thereby controlling the operation of the air conditioner. As described above, the remote control signal receiving unit 150 is provided on the bottom of the front frame 130 considering that the indoor unit 100 is generally mounted at a predetermined height of the inner wall of the room.

In addition, a connecting frame 184 is detachably mounted on a lower end of the front frame 130 to allow the maintenance and replacement of the air discharge vane 122 to be effective performed. This will be described in more detail later.

In addition, the front panel 160 installed in front of the front frame 130 is formed in a rectangular flat plate to define a front contour of the indoor unit 100. That is, the front panel 160 includes a decoration glass 162 that is transparent while, if required, having a predetermined color, and a decoration frame 164 on which the decoration glass 162 is mounted.

Furthermore, the decoration frame 164 is sized and shaped to correspond to the decoration glass 162. The decoration glass 162 may be attached to the decoration frame 164 using an adhesive or coupled to the decoration frame 164 using a coupling unit such as a hook or a screw.

The air discharge panel 170 coupled to a lower portion of the front panel 160 has a length corresponding to a left-and-right length of the front panel 160. The air discharge panel 170 can move upward or downward by a lower panel driving unit 190' (see FIG. 8) that will be described later.

In the indoor unit 100, when the blower fan 114 is driven, the indoor air is introduced into the indoor unit 100 through the air intake grill 132 and air inlet. Then, the air passes through the air filter 144 and electric dust collector 146, in the course of which the foreign objects contained in the air is filtered off. Then, the air is heat-exchanged with the refrigerant while passing through the heat exchanger. In the heating mode, the room temperature increases. In the cooling mode, the room temperature decreases. The air heat-exchanged with the refrigerant is discharged to the room through the air outlet opened by the air discharge vane 122 and air discharge panel 170.

Figure 6:
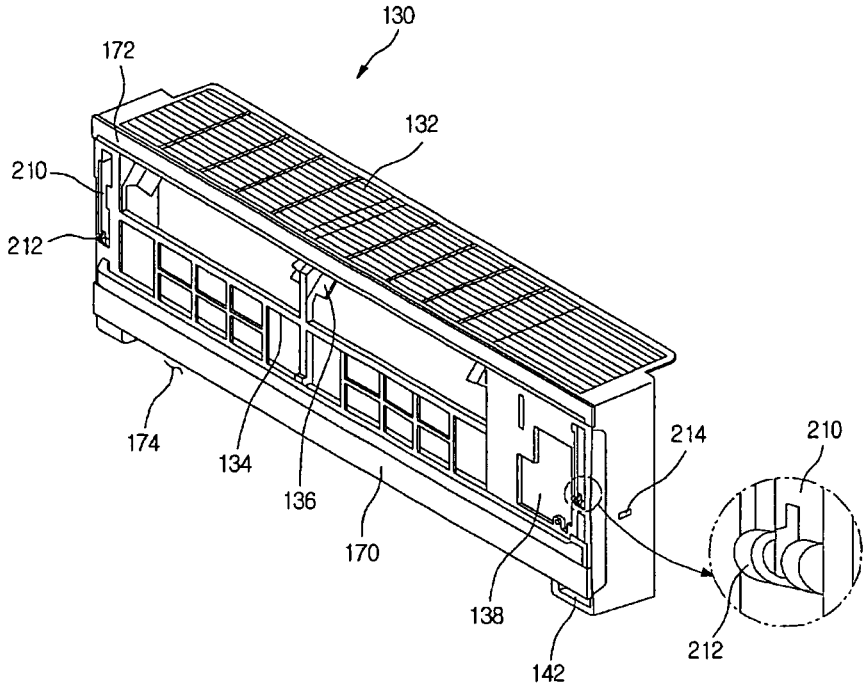
FIGS. 6 and 7 are perspective views of a front frame of FIGS. 2 and 3, when an air discharge panel is coupled to a front upper panel.
Figure 7:
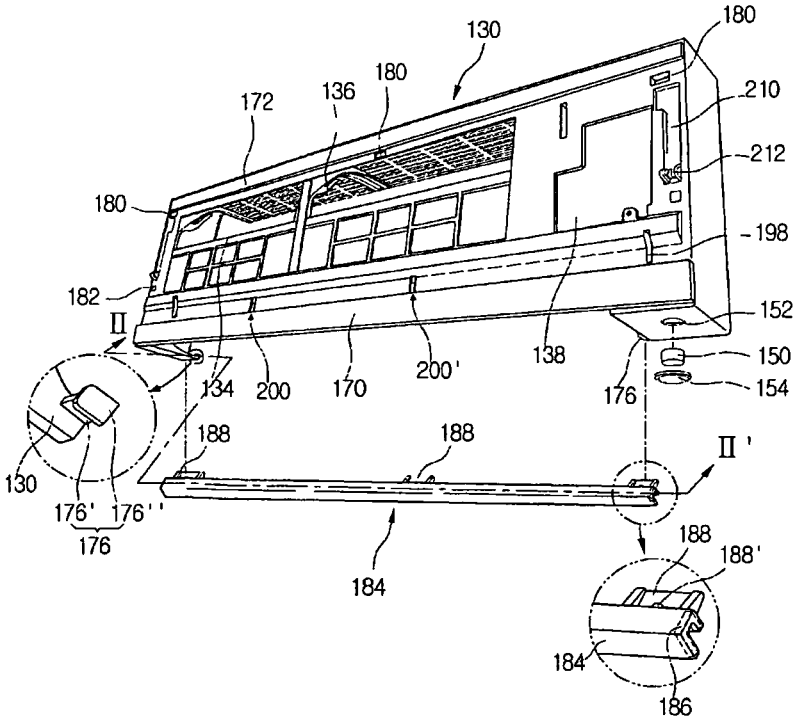
Figure 8:
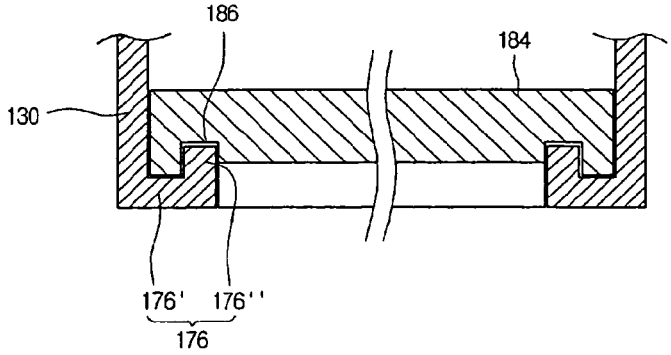
FIG. 8 is a sectional view taken along line II-II of FIG. 7.

FIGS. 6 and 7 are perspective views of the front frame of FIGS. 2 and 3, when an air discharge panel is coupled to the front upper panel and FIG. 8 is a sectional view taken along line II-II' of FIG. 8.

Referring to FIGS. 6, 7 and 8, a frontward air outlet 174 is formed on a lower center portion of the front frame 130. That is, the frontward air outlet 174 is formed to extend from the mode display window 142 to a left end. The air introduced by the blower fan 114 is discharged frontward of the indoor unit 100. Then, the frontward air outlet 174 is selectively screened by the air discharge panel 170. When the air discharge panel 170 moves upward, the frontward air outlet 174 is opened. When the air discharge panel 170 moves downward, the frontward air outlet 174 is screened.

In addition, the front frame 130 is provided at a bottom with a receiving hole 152 in which the remote control signal receiving unit 150. A cover 154 is further installed at a lower portion of the remote control signal unit 150 to enclose the remote control signal receiving unit 150. The cover 154 of the remote control signal receiving unit 150 may be formed of a transparent material.

In addition, the front frame 130 is provided at a front portion with a plurality of coupling and supporting grooves 180 and 182. That is, the coupling and supporting grooves 180 and 192 are portions in which coupling and supporting projections 220 and 222 (see FIG. 12) are inserted. Here, the number and forming positions of the coupling and supporting grooves 180 and 182 are not limited to this embodiment.

Meanwhile, link seating portions 210 are formed on respective front-left and front-right side ends of the front frame 130. Decoration links 230 (see FIG. 12) seat on the link seating portions 210. The link seating portions 210 are concaved to depths corresponding to the decoration lines 230. That is, in a state where the front panel 160 is closed, the decoration links 230 are inserted into the line seating portion 210 and thus no gap is formed between the front panel 160 and the front frame 130.

In addition, a link shaft cover 212 is formed on a lower end of the link seating portions 210. The link shaft cover 212 is a portion in which the link projection 232 formed on an end of the decoration link 230 is inserted. An upper portion of the link shaft cover 212 is partly opened. That is, the link shaft cover is formed in a hook-shape when viewed from a side. The line projection 232 is inserted and hooked on the link shaft cover 212.

In addition, a switch groove 214 is formed on a right side of the front frame 130. An operation switch (not shown) is installed in the switch groove 214. The operation switch is provided to forcedly operate or stop the air conditioner by the user.

Meanwhile, the operation switch is separately provided on the side surface of the front frame 130 or integrally provided with the remote control signal receiving unit 150. That is, the on/off operation switch is inserted in the receiving hole 152 formed on the bottom of the front frame and a remote control signal receiving unit 150 may be installed in the operation switch. At this point, the cover of the operation switch may be formed of a transparent material.

A plurality of guide units 200 and 200 are formed on a front-lower portion of the front frame 130 to guide the vertical movement of the air discharge panel 170 without shaking or moving in a side direction. The guide units 200 and 200 will be described in more detail with reference to the accompanying drawings later.

The connecting frame 184 is detachably mounted on the lower end of the front frame 130. That is, the connecting frame 184 is coupled to a rear portion of the air discharge vane 122 to prevent the cooled air from leaking downward of the indoor unit 100 in a state where the air discharge vane 122 is closed. The connecting frame 184 may be separated so as to perform the replacement or maintenance service for the air discharge vane 122 or the air discharge louver. That is, a user can insert his/her hand through a space formed by separating the connecting frame and perform the replacement and maintenance of the internal components.

Furthermore, the connecting frame 184 is detachably mounted on a bottom-rear end of the front frame 130. That is, a rear side of the frontward air outlet 174 is opened and the connecting frame 184 is mounted in the opened portion of the frontward air outlet 174. The opposite ends of the connecting frame 184 are inserted around coupling hooks protruding from opposite sides of the front frame 130.

The connecting frame 184 is also coupled to the lower end of the main chassis 110. Therefore, the connecting frame 184 functions to couple the front frame 130 to the main chassis 110.

That is, a pair of connecting hooks are formed on a lower-rear end of the front frame 130. The coupling hook 176 includes a supporting portion 176 protruding inward from the opposite ends of the front frame 130 and a hook portion 176" formed on an end of the supporting portion 176.

The hook portion 176" is arranged on the end of the supporting portion 176 in a direction crossing the supporting portion 176'

As shown in FIG. 8, the hook portion 176" is inserted in a hook groove 186 of the connecting frame 184. The hook groove 186 is formed on each end of the connecting frame 184.

In addition, the connecting frame 184 is provided with a plurality of fixing portions 188 for coupling the connecting frame 184 to the main chassis 110. As shown in FIG. 7, the fixing portions 188 are formed to extend upward from the central portion and left and right side ends of the connecting frame 184.

A fixing hole 188 is formed through the fixing portion 188. The fixing hole 188 is provided to receive a screw. A chassis fixing portion corresponding to the fixing portion 188 of the connecting frame 184 may be provided on a lower end of the main chassis 110. Therefore, the screw is inserted into the chassis fixing portion of the main chassis through the fixing hole 188'

Describing a coupling process of the connecting frame 184, the connecting frame 184 is disposed such that the opened portion thereof is oriented rearward of the indoor unit 100. Then, the supporting portion 176 is inserted into the opened portion of the connecting frame 18. Then, the hook portion 176" of the coupling hook 176 is inserted into the hook groove 186 of the connecting frame 184. When the hook portion 176" is fully inserted into the hook groove 186, the fixing portion 188 closely contacts the chassis fixing portion of the main chassis. In this state, the screw is inserted to fix the fixing portion 188 on the main chassis 110.

Figure 9:
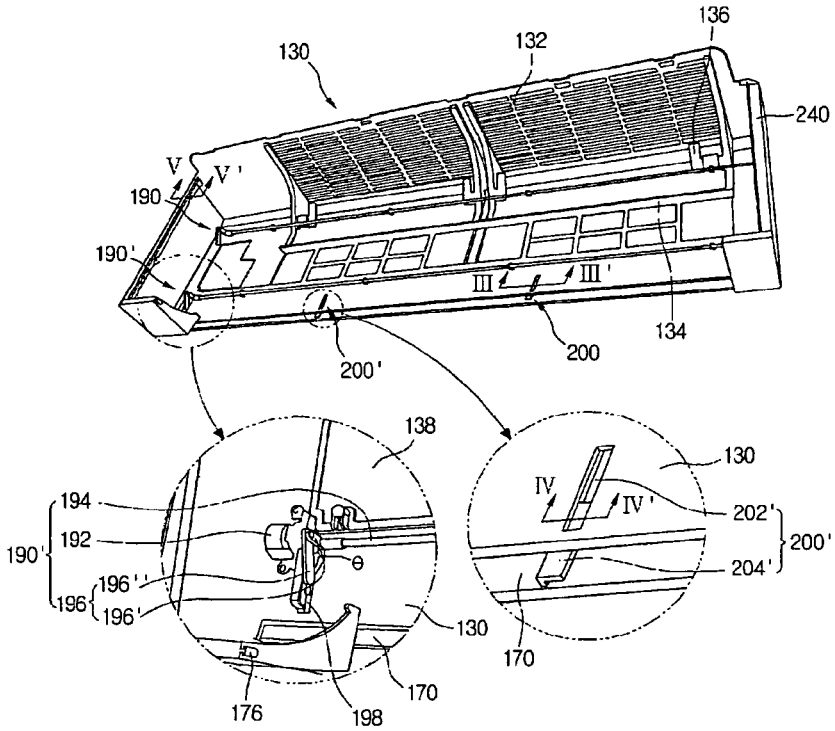
FIG. 9 is a rear perspective view of the front frame of FIGS. 6 and 7.

FIG. 9 is a rear perspective view of the front frame.

Referring to FIG. 9, panel driving units 190 and 190 are respectively installed on a rear surface of the front frame to control the vertical movement of the air discharge panel 170 and the front-upper panel 172. That is, the upper panel driving unit 190 is provided near the rear-upper end of the front frame 130 and the lower panel driving unit 190 is provided on the rear-lower end of the front frame to control the vertical movement of the air discharge panel 170.

The upper and lower panel driving units 190 and 190 are identical in the structure to each other. The upper and lower panel driving units 190 and 190 are symmetrically installed in the vertical direction. In the following description, only the lower panel driving unit 190 will be described.

The panel driving unit 190 includes a driving motor 192 installed on a rear left end or a rear right end of the front frame 130 to generate rotational force, a driving shaft installed on the rear surface of the front frame 130 horizontally transmit the rotational force generated by the driving motor 192, a shaft supporting unit 195 for supporting the driving shaft 194, and a link 196 for connecting the driving shaft 194 to the front-upper panel 172 or the air discharge panel 170.

The driving motor 192 may be a step motor installed on the rear surface of the front frame 130. The driving shaft 194 extends from a central axis of the driving motor 192 to transmit the rotational force generated from the driving motor 192 to the link 196. The driving shaft 194 extends from a left end to a right end of the front frame 130. The link 196 is pivotally installed on the both ends of the driving shaft 194.

The link 196 is provided by a plurality to convert the rotation motion of the driving shaft 194 into a vertical motion and transmit the vertical motion to the air discharge panel 170 or the front-upper panel 172.

That is, the link 196 includes a shaft link 196 fixedly coupled to the driving shaft 194 and a panel link 196" hingedly coupled to the air discharge panel 170 or front-upper panel 172. The shaft link 196 is pivotally coupled to the panel link 196". Therefore, the shaft link 196 and the panel link 196" may be linearly arranged or arranged with a between angle. Therefore, the air discharge panel 170 or front-upper panel 172 can move upward or downward.

Connecting slits 198 are formed on left and right side ends of the front frame 130 and the panel link 196" is connected to the air discharge panel 170 or front-upper panel 172 through the connecting slits 198. Therefore, by the rotational force of the driving motor 192, the air discharge panel 170 and the front-upper panel 172 move upward or downward as the between angle θ is reduced and increased. That is, as the between angle is reduced, the air discharge panel 170 moves upward to open the frontward air outlet 174. The front-upper panel 172 moves downward to expose the display window to the external side.

On the contrary, when the angle between the shaft link 196 and the panel link 196" increases or becomes 180°, the air discharge panel 170 moves downward and the front-upper panel 172 moves upward. Therefore, the frontward air outlet 174 is screened by the air discharge panel 170 and the display window is 140 closed by the front-upper panel 172 so that the information display on the main display unit 120 cannot be identified from the external side.

Meanwhile, the front frame 130 is further provided with guide units 200 and 200' for guiding the vertical movement of the air discharge panel 170.

That is, the guide unit 200 is provided on a left side of the front frame 130 when viewed from a front side and the guide unit 200 is provided on a right side of the front frame 130. The guide units 200 and 200 are symmetrically disposed. The coupling structure of the guide units 200 and 200 will now be described in detail with reference to the accompanying drawings.

Figure 10:
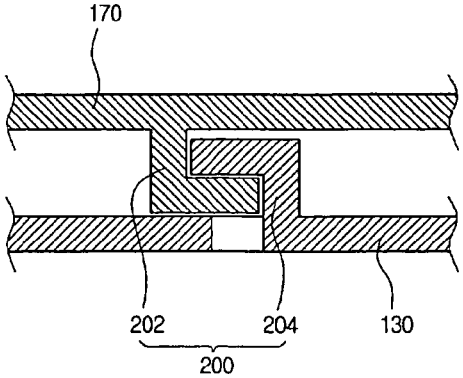
FIG. 10 is a sectional view taken along line III-III' of FIG. 9.
Figure 11:
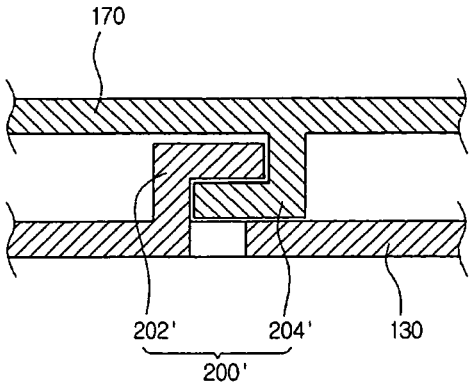
FIG. 11 is a sectional view taken along line IV-IV' of FIG. 9.

FIG. 10 is a sectional view taken along line of FIG. 8 and FIG. 11 is a sectional view taken along line IV-IV'

Referring to FIGS. 9 and 10, the guide unit 200, 200 includes a frame guide 202, 202' and a panel guide 204, 204'

That is, the left guide unit 200 includes the left frame guide 202 and the left panel guide 204. The right guide unit 200 includes the right frame guide 202 and the right panel guide 204'

That is, the left and right guide units 200 and 200 are symmetrical with reference to the vertical line. That is, the left and right frame guides 202 and 202' are symmetrical with each other and the left and right panel guides 204 and 204' are also symmetrical with each other.

For example, the left panel guide 204 extends downward from the bottom of the air discharge panel 170 and perpendicularly bent rightward to have a ⌊-shape. The right panel guide 204 extends downward from the bottom of the air discharge panel 170 and bent leftward to have a ⌋-shape.

In addition, the left frame guide 202 extends vertically upward from the top of the front frame 130 and bent leftward to have ⌉-shape and the right frame guide 202 extends upward from the top of the front frame 130 and bent right ward to have a ⌈-shape.

Accordingly, the left panel guide 204 and the left frame guide 202 slide in a state where they are combined and the right panel guide 204 and the right frame guide 202' slide in a state where they are combined.

The reason for symmetrically forming the left and right guide units 200 and 200 is to prevent the air discharge panel 170 and the front frame 130 from being sided during the sliding motion thereof and thus prevent them from being separated from the front frame 130.

Figure 12:
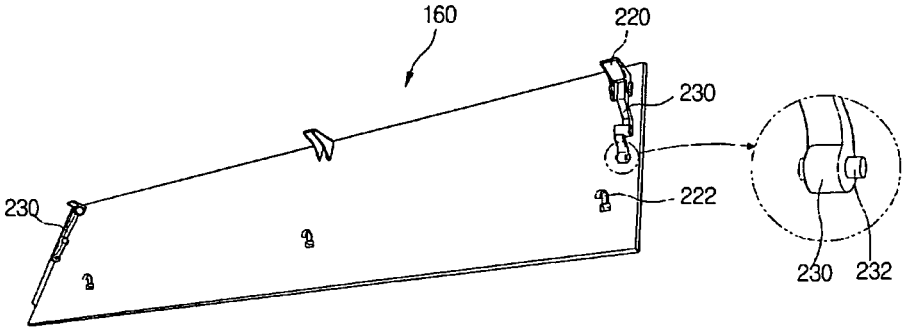
FIG. 12 is a rear perspective view of a front panel according to an embodiment of the present invention.

FIG. 12 is a rear perspective view of the front panel according to an embodiment of the present invention.

Referring to FIG. 12, a plurality of coupling and supporting projections 220 and 222 are formed on the rear surface of the front panel 160.

That is, three coupling projections 220 are formed to extend rearward at a central-left and central-right ends near the rear-upper end of the front panel 160. The coupling projections 220 are inserted into coupling grooves 180 of the front frame 130. Once the coupling projections 220 are inserted into the coupling grooves 180, they are not removed from the coupling grooves 180 unless the external force is applied thereto.

Meanwhile, the supporting projections 222 are provided on the rear-lower portion of the front panel 160. The supporting projections 222 extend rearward from the rear surface of the front panel 160 and are inserted into the supporting grooves 182 of the front frame 130.

The supporting projection 222 is formed in a hook-shape and a hook member may be provided in the supporting groove 182 so that the supporting projection 222 is pivotally hooked thereon. Therefore, the front panel 160 can pivot within a predetermined angle range in a state where the supporting projections 222 are inserted into the supporting grooves 182. That is, the front panel 160 is designed to be opened by pivoting frontward of the front frame 130. When the front panel 160 pivots around the supporting projections 222.

Meanwhile, the decoration links 230 are installed on the opposite ends of the front panel 160 to control the frontward pivot motion of the front panel 160.

First ends of the decoration links 230 are pivotally inserted in the left and right side ends of the rear-upper end of the front panel 160. The second ends of the decoration links 230 are pivotally inserted to the front frame 130. The decoration links 230 are formed of one, two or three links. The first ends of the decoration links 230 are hingedly coupled to the rear surface of the front panel 160. The second ends of the decoration links 230 are pivotally inserted in the link shaft cover 212 of the front frame 130. The link projection 232 protrudes sideward at an end of the decoration link 230. The link projection 232 is inserted and hooked in and on the link shaft cover 212 of the front frame 130. That is, the link projection 232 is inserted or removed through an upper opening of the link shaft cover 212.

Figure 13:
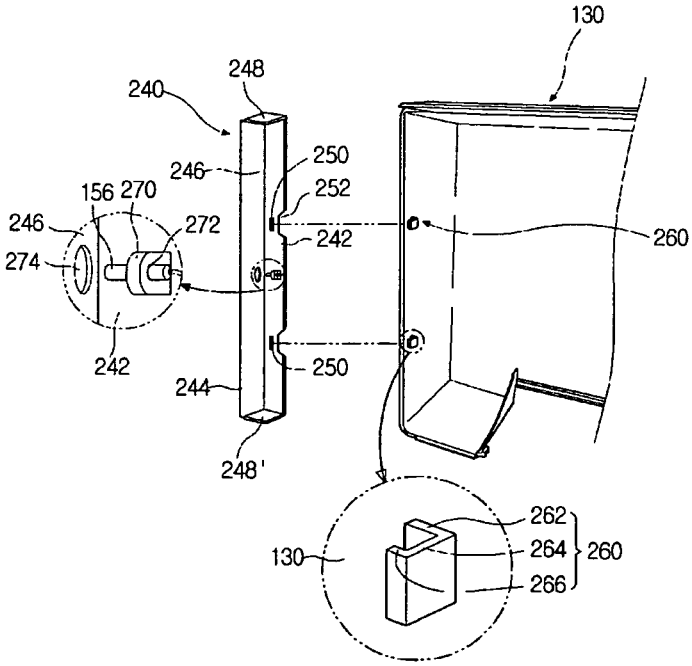
FIG. 13 is a partly exploded perspective view illustrating an air sealing member coupled to a front frame according to an embodiment of the present invention.
Figure 14:
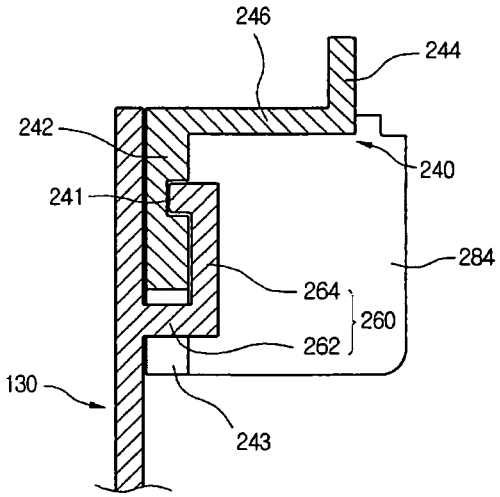
FIG. 14 is a sectional view taken along line V-V' of FIG. 9.

FIG. 13 is a partly exploded perspective view illustrating an air sealing member coupled to a front frame according to an embodiment of the present invention and FIG. 14 is a sectional view taken along line V-V of FIG. 9.

Referring to FIGS. 13 and 14, installed between the front frame 130 and the main chassis 110 is an air sealing member 240 for blocking the airflow. That is, when a left-right width of the front frame 130 is different from that of the main chassis 110, an air sealing member 240 for blocking a gap formed by the width difference is disposed between the front frame 130 and the main chassis 110.

As described above, panel driving units 190 and 190' for vertically moving the front-upper panel 172 and the air discharge panel 170 are installed on the rear surface of the front frame 130. Therefore, the left-right width of the front frame 130 increases to provide a space where the panel driving units 190 and 190' will be installed.

As a result, the left-right width of the front frame 130 becomes greater than that of the main chassis 110, thereby forming a predetermined gap between the front frame 130 and the side surface of the main chassis 110. Therefore, the air sealing member 240 for blocking the gap formed by the width difference between the front frame 130 and the main chassis 110 is provided on left and right rear ends of the front frame 130.

Therefore, the front frame 130 is provided with a coupling hook 260 for mounting the air sealing member 240. As shown in the drawings, the coupling hook 260 extends from an inner side surface of the front frame 130. The coupling hook 260 is inserted in a hook groove 250 of the air sealing member 240.

The coupling hook 260 includes a supporting portion 262 extending from the inner side surface of the front frame 130, a hook portion 264 bent perpendicularly from an end of the supporting portion 262, and a hook step 266 further bent from an end of the hook portion 264.

The hook step 266 is shorter than the supporting portion 262 and inserted into the hook groove 250 of the air sealing member 240.

The air sealing member 240 includes a front plate 242 contacting the side surface of the front frame 130, a chassis plate 244 contacting the side surface of the main chassis 110, a shield plate 246 connecting the front plate 242 to the chassis plate 244, and upper and lower plates 248 and 248' contacting respectively a top and bottom of the front frame 130.

The shield plate 246 is disposed to be perpendicular to the front and chassis plates 242 and 244 to block the gap between the front frame 130 and the main chassis 110.

The front plate 242 is provided at upper and lower portions with hook grooves in which the coupling hooks 260 will be inserted. The number and shape of the hook grooves 250 correspond to those of the coupling hooks 260. That is, the hook groove 250 is configured to correspond to the hook step 266 of the coupling hook 260. The hook step 266 is inserted in the hook groove 250.

A hook guide groove 252 is further formed on the end of the front plate 242. That is, a part of the front plate 242 is cut away to form the hook guide groove 252. The hook guide groove 252 functions to guide the coupling of the coupling hook 260. That is, the supporting portion 262 of the coupling hook 260 is inserted in the hook guide groove 252.

Meanwhile, a room temperature sensor 156 for measuring the temperature of air being introduced into the indoor unit.

That is, the room temperature sensor 156 is detachably mounted on the front surface of the air sealing member 240.

Describing in more detail, the front plate 242 of the air sealing member 240 is provided at an inner surface with a sensor holder 270 on which the room temperature sensor 156 is detachably mounted. The front plate 242 is further provided at a central portion with a sensor hole 272 in which the room temperature sensor 256 is mounted.

In addition, the shielding plate 246 of the air sealing member 240 is provided with an air hole 274 through which the room air is introduced. Therefore, the room air introduced through the air hole 254 contacts the room temperature sensor 156.

That is, the air hole 274 is formed near the room temperature sensor 156 so that the air passing through the air sealing member 240 flows via the room temperature sensor 156.

Figure 15:
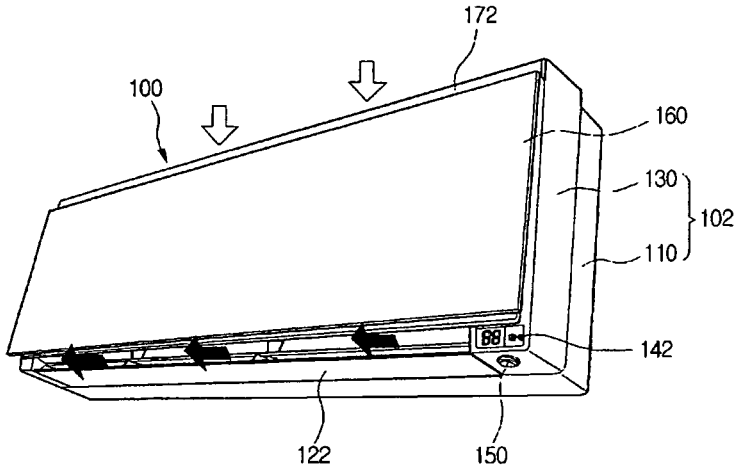
FIG. 15 is a perspective view of an indoor unit discharging air frontward according to an embodiment of the present invention.
Figure 16:
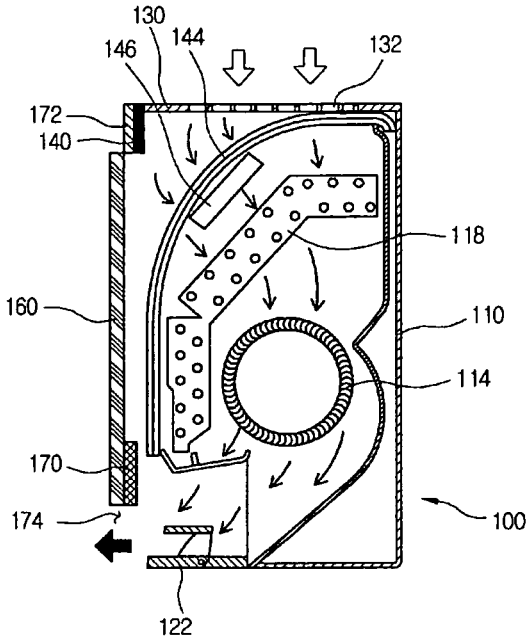
FIG. 16 is a sectional view of airflow in the indoor unit of FIG. 15.

FIG. 15 is a perspective view of the indoor unit discharging air frontward according to an embodiment of the present invention and FIG. 16 is a sectional view of airflow in the indoor unit of FIG. 15.

Referring to FIGS. 15 and 16, the indoor unit 100 of the present invention can be configured to discharge the air only frontward.

That is, in order to discharge the air only frontward of the indoor unit 100, the air discharge panel 170 is designed to move upward by the lower panel driving unit 190 in a state where the air discharge vane 122 is closed. That is, the angle between the shaft link 196 and the panel link 196" is reduced by the driving motor 192. Then, the air discharge panel 170 is guided by the guide units 200 and 200 to move upward of the front frame 130. As a result, the frontward air outlet 174 is opened to allow cooled or heated air to be discharge to the room through the frontward air outlet 174.

In addition, as the air discharge panel 170 moves upward, the mode display window 142 is exposed frontward and thus the user can identify the current operation mode of the air conditioner through the mode display window 142.

Figure 17:
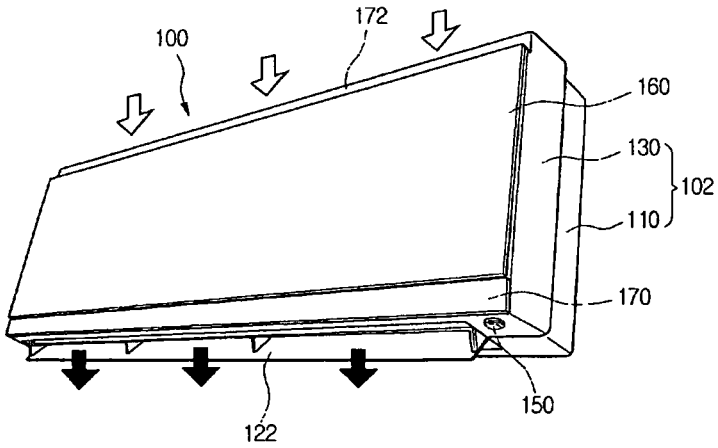
FIG. 17 is a perspective view of an indoor unit discharging air downward according to an embodiment of the present invention.
Figure 18:
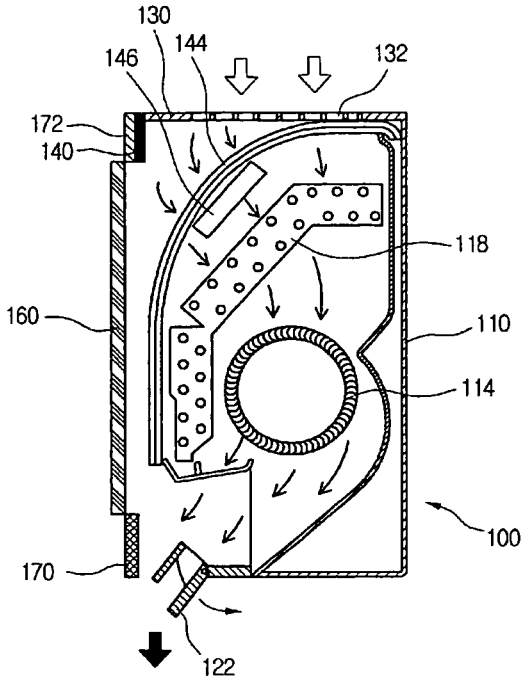
FIG. 18 is a sectional view of airflow in the indoor unit of FIG. 17.

FIG. 17 is a perspective view of the indoor unit discharging air downward according to an embodiment of the present invention and FIG. 18 is a sectional view of airflow in the indoor unit of FIG. 17.

Referring to FIGS. 17 and 18, the indoor unit 100 of the present invention can operate to discharge the air only downward.

That is, in order to discharge the air only downward of the indoor unit 100, the air discharge panel 170 is designed to maintain its downward state to screen the frontward air outlet 174. Then, the air discharge vane 122 pivots by a predetermined angle to open the downward air outlet. Then, the air is guided by the air discharge vane 122 and discharged downward from the indoor unit 100.

Figure 19:
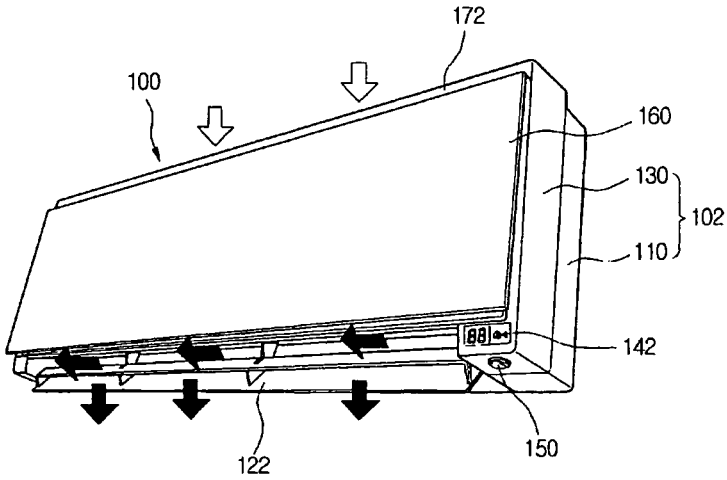
FIG. 19 is a perspective view of an indoor unit discharging air downward and frontward according to an embodiment to of the present invention.
Figure 20:
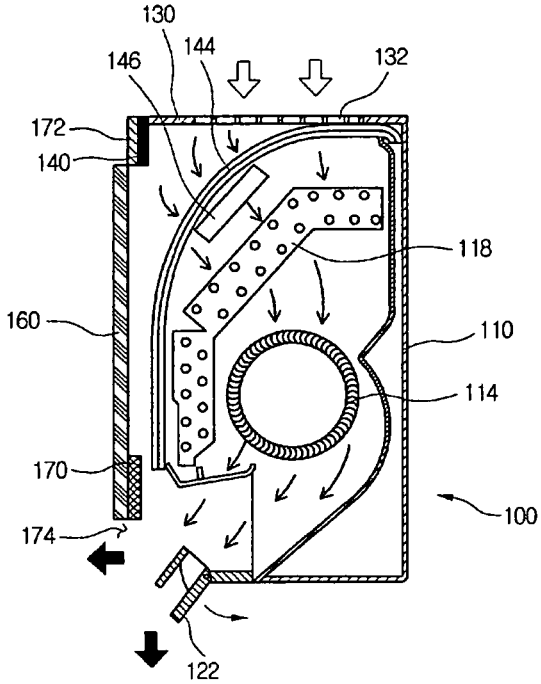
FIG. 20 is a sectional view of airflow in the indoor unit of FIG. 19.

FIG. 19 is a perspective view of the indoor unit discharging air downward and frontward according to an embodiment to of the present invention and FIG. 20 is a sectional view of airflow in the indoor unit of FIG. 19.

Referring to FIGS. 19 and 20, the indoor unit 100 of the present invention can operate to discharge the air frontward and downward.

That is, in order to discharge the air downward and frontward of the indoor unit 100, the air discharge panel 170 is designed to move upward to open the frontward air outlet 174 and the air discharge vane 122 pivots by a predetermined angle to open the downward air outlet. Then, the air is discharged frontward of the indoor unit 100 through the frontward air outlet as well as downward through the air discharge vane 122.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the present invention, since the connecting frame is provided on a lower end of the front panel, the replacement and maintenance for the internal components such as the air discharge vane can be efficiency performed. The air leakage can be prevented by the air sealing member. The room temperature can be accurately measured by the room temperature sensor. Therefore, the present invention is very likely to be applied to the industry.

The invention claimed is:

1. An indoor unit for an air conditioner, comprising:
- a front frame;
- a main chassis coupled on a rear portion of the front frame;
- an air discharge vane provided on a lower end of the front frame to control a discharge direction of cooled air;
- an connecting frame provided on a rear portion of the air discharge vane; and
- an air sealing member connecting the front frame to a side surface of the main chassis.

2. The indoor unit according to claim 1, wherein both ends of the connecting frame are slidably coupled on an inner surface of the front frame.

3. The indoor unit according to claim 1, wherein the connecting frame is coupled to both of the front frame and the main chassis.

4. The indoor unit according to claim 1, further comprising a room temperature sensor provided on the air sealing member.

5. The indoor unit according to claim 1, further comprising a front panel detachably coupled to the front frame.

6. An indoor unit for an air conditioner, comprising:
- a casing including a front frame and a main chassis;
- an air discharge panel slidably coupled to the front frame;

an air discharge vane provided on a lower end of the casing to discharge the cooled air downward; and an air sealing member connecting the front frame to a side surface of the main chassis to prevent air leakage.

7. The indoor unit according to claim 6, wherein the air sealing member is bent at a plurality of portions so that it can be applied even when a width of the front frame is different from that of the main chassis.

8. The indoor unit according to claim 6, wherein the air sealing member includes a front plate contacting the side surface of the front frame, a chassis plate contacting the side surface of the main chassis, a shield plate connecting the front plate to the chassis plate, and upper and lower plates contacting respectively a top and bottom of the front frame.

9. The indoor unit according to claim 8, further comprising a room temperature sensor detachably mounted on the front plate to detect the room temperature.

10. The indoor unit according to claim 8, wherein the chassis plate is provided at a predetermined portion with an air hole through which the room air is introduced.

11. The indoor unit according to claim 6, further comprising a coupling portion extending from a side surface of the front frame to fix the air sealing member to the front frame and a groove formed on the air sealing member to receive an end of the coupling portion.

12. The indoor unit according to claim 6, further comprising a plurality of coupling hooks extending from a side surface of the front frame and bent at a plurality of portions; and a plurality of hook grooves in which ends of the coupling hooks are inserted, the hook grooves being formed on a surface of the air sealing member.

13. The indoor unit according to claim 6, further comprising a connecting frame provided on a rear portion of the air discharge vane and having both ends slidably coupled to an inner surface of the front frame.

14. The indoor unit according to claim 13, wherein the connecting frame is coupled to the front frame and then fixed on the main chassis by a coupling member.

15. An indoor unit for an air conditioner, comprising:

a front frame;

a main chassis coupled on a rear portion of the front frame;

an air sealing member connecting the front frame to a side surface of the main chassis;

a connecting frame slidably coupled to a lower end of the front frame; and a temperature sensor provided on the air sealing member to measure the temperature of the room air.

16. The indoor unit according to claim 15, further comprising a coupling portion extending from a lower end side surface of the front frame so that both ends of the connecting frame are slidably inserted therein.

17. The indoor unit according to claim 16, wherein the connecting frame is bent at a plurality of portions and provided with grooves in which the coupling portions are inserted.

18. The indoor unit according to claim 15, wherein the air sealing member includes a front plate closely contacting the side surface of the front frame, a chassis plate closely contacting the side surface of the main chassis, and a shield plate connecting the front plate to the chassis plate, and the temperature sensor is fixed on the front plate by a sensor holder.

19. The indoor unit according to claim 18, wherein the shield plate is provided with an air hole through which the room air is introduced so that the room air contacts the temperature sensor.

* * * * *